United States Patent [19]

Egbers et al.

[11] 4,406,312

[45] Sep. 27, 1983

[54] APPARATUS FOR SELECTING A NUMBER OF WEFT THREADS AT WEAVING MACHINES

[75] Inventors: Gerhard Egbers; El S. El Helw, both of Reutlingen; Helmut Weinsdörfer, Pliezhausen, all of Fed. Rep. of Germany

[73] Assignee: Aktiengesellschaft Adolf Saurer, Arbon, Switzerland

[21] Appl. No.: 269,033

[22] PCT Filed: Sep. 29, 1980

[86] PCT No.: PCT/CH80/00115

§ 371 Date: May 26, 1981

§ 102(e) Date: May 26, 1981

[87] PCT Pub. No.: WO81/01017

PCT Pub. Date: Apr. 16, 1981

[30] Foreign Application Priority Data

Oct. 4, 1979 [DE] Fed. Rep. of Germany ..... 2940202

[51] Int. Cl.[3] ..... D03D 47/38

[52] U.S. Cl. ..... 139/453

[58] Field of Search ..... 139/453

[56] References Cited

U.S. PATENT DOCUMENTS

| | | | |
|---|---|---|---|
| 3,237,651 | 3/1966 | Ancet et al. | 139/453 |
| 3,315,708 | 4/1967 | Scheffel | 139/453 |
| 3,532,135 | 10/1970 | Freihofer | 139/453 |
| 3,825,038 | 7/1974 | Ormerod | 139/453 |
| 3,903,930 | 9/1975 | Muller | 139/453 |
| 4,076,054 | 2/1978 | Merisio | 139/453 |
| 4,132,249 | 1/1979 | Camprubi | 139/453 |
| 4,191,222 | 3/1980 | Marshall | 139/453 |
| 4,326,566 | 4/1982 | Lampaert | 139/453 |

FOREIGN PATENT DOCUMENTS 874724 7/1979 Belgium .

*Primary Examiner*—Henry Jaudon

*Attorney, Agent, or Firm*—Werner W. Kleeman

[57] ABSTRACT

The invention relates to a weaving loom which is provided with a selection device allowing the programmed selection of that weft thread among a plurality of threads which has to be inserted into the weaving shed by means of an insertion device. The selection device comprises a program control device and a positioning device controlled by such program control device, which positioning device moves the weft thread carrier so that only the selected weft thread is brought to an active position ready to be inserted into the weaving shed. The selection device comprises a microcomputer provided with a microprocessor, a read-only memory, a pattern computer and a keyboard intended for programming and operating. The positioning device is provided with electromagnets controlled by program control signals of the program control device, which electromagnets control the positioning of the weft thread carriers so as to move the weft threads from the passive positions to the active positions and vice-versa.

6 Claims, 7 Drawing Figures

FIG. 5
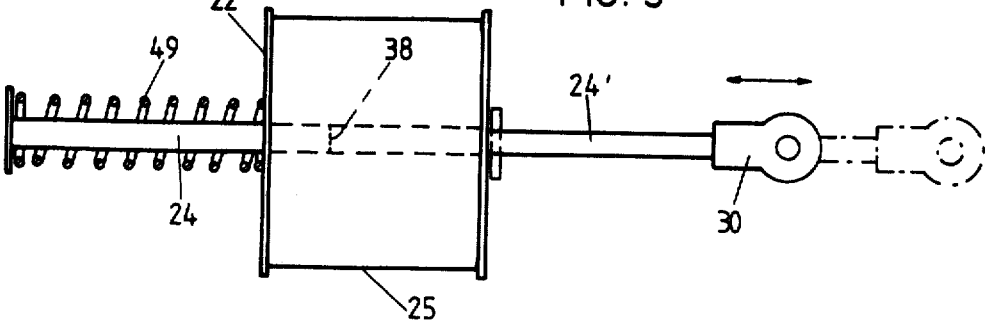
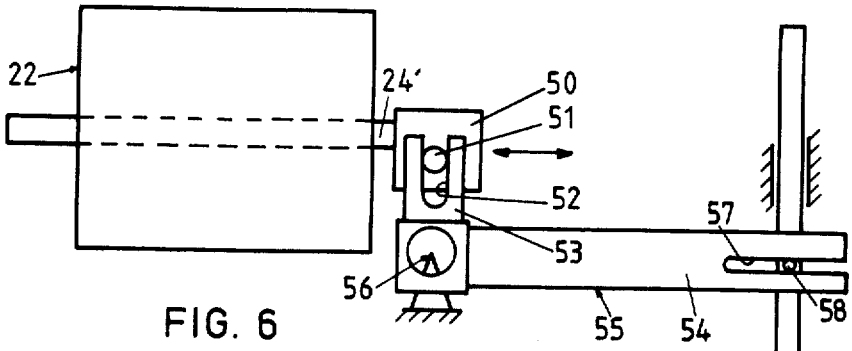
FIG. 6
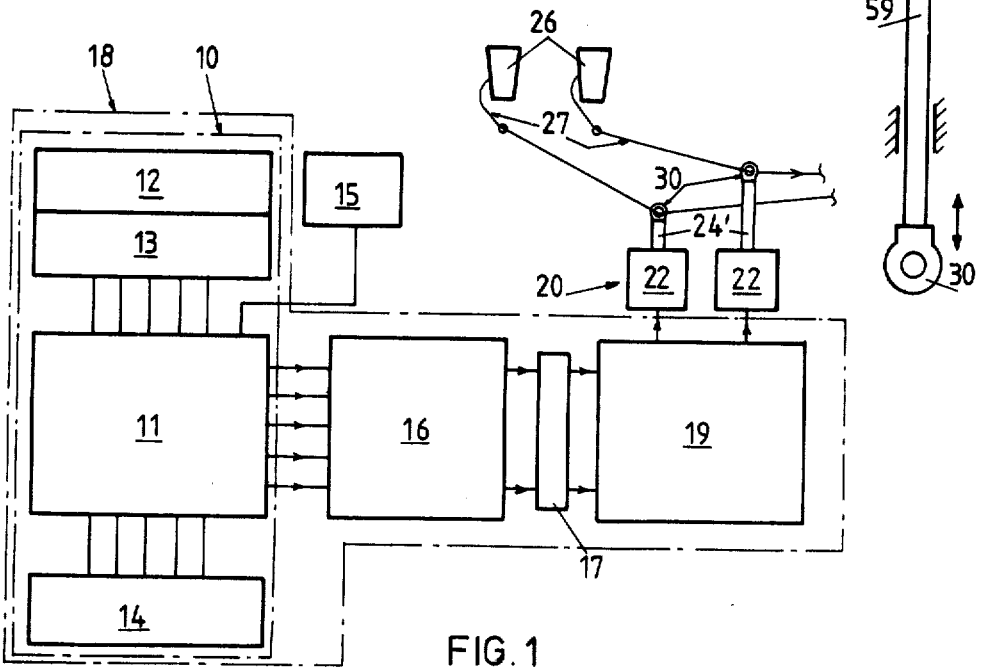
FIG. 1

FIG. 4
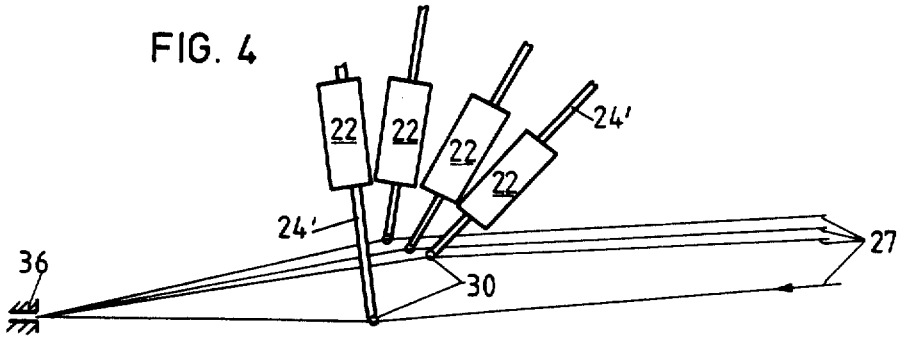
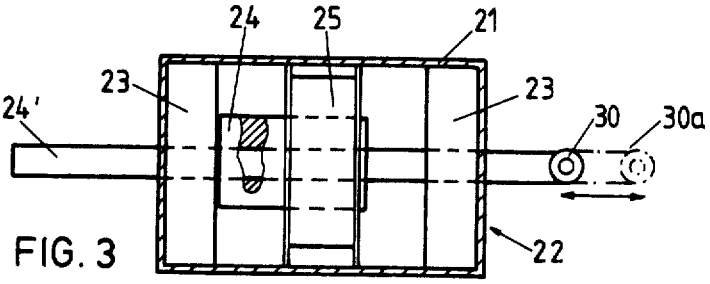
FIG. 3
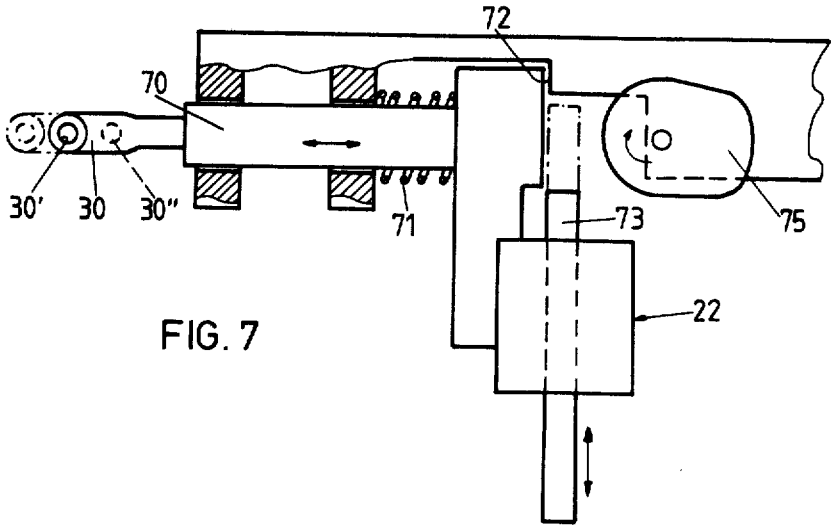
FIG. 7

APPARATUS FOR SELECTING A NUMBER OF WEFT THREADS AT WEAVING MACHINES

The present invention relates to a weaving machine, especially to a shuttleless loom.

TECHNICAL FIELD

The weft threads can preferably be weft threads of different colors and/or different composition, size and the like. However, the weft threads can also be of the same kind, and can be used for rendering more even the woven structure (fabric structure) by inserting them in an alternating mixture into the fabric web.

The weaving machine can preferably be a shuttleless weaving machine, i.e. a weaving machine which has no shuttles containing weft bobbins. Shuttleless weaving machines mostly insert the weft thread into the loom shed by means of grippers, projectiles, air or water nozzles or gripper shuttles which do not contain weft bobbins. Wave weaving machines are also regarded as shuttleless weaving machines because their shuttles carry no weft bobbins but are loaded with the weft thread only before the weft insertion. However, the invention may equally be used for weaving machines incorporating shuttles which carry inserted weft thread bobbins, whereby during each weft thread exchange a corresponding shuttle exchange takes place.

SIGNIFICANT STATE OF THE ART

In a known weaving machine (Dornier) with insertion of the weft threads by means of grippers the program for selecting the weft threads is programmed by punch cards. Needles read the punch cards and, by means of mechanical drives, control plates which are movable into two different positions by means of blades pivoting in accordance with the working cycle of the machine, whereby depending upon the positional combination of these plates, one of the weft threads is in its active position and the remaining weft threads are in passive positions. This positioning device is constructionally complicated, expensive, requires much maintenance and, as a consequence of the comparatively large inertia masses which are to be selected for each weft thread exchange, offers only limited possibilities for increasing its operating frequency. Other known weaving machines have selection devices which are even more expensive and have considerably larger inertia masses which have to be accelerated for each weft thread exchange.

DISCLOSURE OF THE INVENTION

It is therefore an object of the invention to provide a weaving machine to the previously mentioned type comprising a selection device which is considerably easier to build, can be manufactured at low cost, needs little maintenance and also makes possible high operating frequencies.

This object is attained, in accordance with the weaving machine, in that the program control device is constructed so as to produce electric program control signals and the positioning device is provided with at least one electromagnet responsive to program control signals from the program control device, whereby the electromagnet or the electromagnets control the positioning of the weft thread carrier or carriers and which positioning serves to transfer the weft thread from the passive position to the active position and vice-versa.

The weft thread carrier can preferably be a weft thread guide which can guide to the effective path of a weft insertion device one or more weft threads coming from weft thread bobbins, i.e. a weft thread guide which allows such weft thread or threads to be transferred from a passive position to the momentary active position. The weft thread insertion device can preferably comprise at least one gripper serving for the weft insertion, one or more projectiles, gripping shuttles or the like or the shuttles in wave weaving machines. The weft insertion can also take place pneumatically by means of compressed air nozzles or by means of water jet nozzles. There are also other ways of inserting the weft thread. In some cases the weft thread carrier can be a shuttle incorporating a weft thread bobbin. If the weft thread carrier holds the weft thread, this weft thread carrier can be, for instance, a thread clamp which, in the passive position, is closed for holding the weft thread and, in the active position of the weft thread, is opened so that the weft thread can be inserted into the weaving shed.

The weaving machine according to the invention has numerous advantages. It allows the program control device and the positioning device to be constructed in a particularly simple way. The program control device can preferably comprise a microcomputer. However, other embodiments, if not quite as valuable, are possible, preferably a program control device of which the program storage is a punch tape or a punch card which is read preferably electrically or photoelectrically. In the simplest case, the positioning device can essentially consist only of one or more electromagnets and weft thread carriers.

The electromagnet or electromagnets of the positioning device can preferably be bistable switching magnets.

The positioning device can be constructed without difficulty so as to have only relatively small inertia masses which are to be accelerated for each weft thread exchange, so that high operating frequencies of the weft thread exchange can be attained. In addition, energy savings can be achieved as a result of the smaller inertia masses which are to be accelerated.

The positioning device can also be built without difficulty so as to work noiselessly. Furthermore, it is reliable in operation, requires little maintenance and is easy and inexpensive to manufacture. Also the positioning device can be so constructed as to require only little space. The program control device can likewise be compactly built. Also the program control device does not need to be arranged close to the positioning device because only an electrical connection is required between the two.

Preferably, it is contemplated that the electromagnet or electromagnets of the positioning device supply all the energy needed for positioning the associated weft thread carrier or carriers. This can preferably be effected in that the electromagnet moves such weft thread carrier to its active position as well as to its passive position, especially if the electromagnet is a bistable switching magnet. However, it can also be contemplated that the electromagnet-induced movement of the weft thread carrier in one direction tensions return spring means or increases the pre-tension of return spring means, whereby such means move the weft thread carrier back to its original position, when the electromagnet is de-energized.

Especially if the weft thread carrier has a relatively great mass, so that considerable forces have to be applied for its quick positional adjustment or if the weft thread carrier has to move through a relatively long path of motion, a direct drive of the weft thread carrier by the electromagnets does not seem advisable and it can be contemplated that the electromagnet or electromagnets serve for actuating a control device for controlling a preselection apparatus which adjusts the weft thread carrier or carriers by means of the drive from the main motor of the weaving machine. Preselection apparatuses which are basically suitable for this purpose can be constructed similar to known preselection apparatuses heretofore serving for different programmed weaving shed forming in known weaving machines. However, the control by the electromagnet or the electromagnets also allows a simpler construction of such preselection apparatus.

BRIEF DESCRIPTION OF THE DRAWINGS

In the drawings, exemplary embodiments of the invention are shown. There are shown in:

FIG. 1 a selection device with a microcomputer represented in block circuit diagram, which microcomputer controls a positioning device with two bistable switching magnets, FIG. 2 a positioning device for program controlled transport of four weft threads, which are positionally adjustable by means of a single common weft thread carrier, FIG. 3 a schematic view of an electromagnet constructed as a bistable switching magnet, the housing of which is shown in sectional view, FIG. 4 a positioning device with four electromagnets serving for the positioning of four weft thread carriers in a not further illustrated weaving machine, FIG. 5 a monostable electromagnet which serves for direct displacement of a weft thread carrier, FIG. 6 an electromagnet which serves for the displacement of a weft thread carrier by means of a mechanical drive, FIG. 7 a positioning device which incorporates a preselection apparatus driven by the main motor of the weaving machine.

In the drawings, several elements which have the same function are designated by the same reference characters, even if such elements are constructed differently.

PREFERRED EMBODIMENTS OF THE INVENTION

Figure 2:
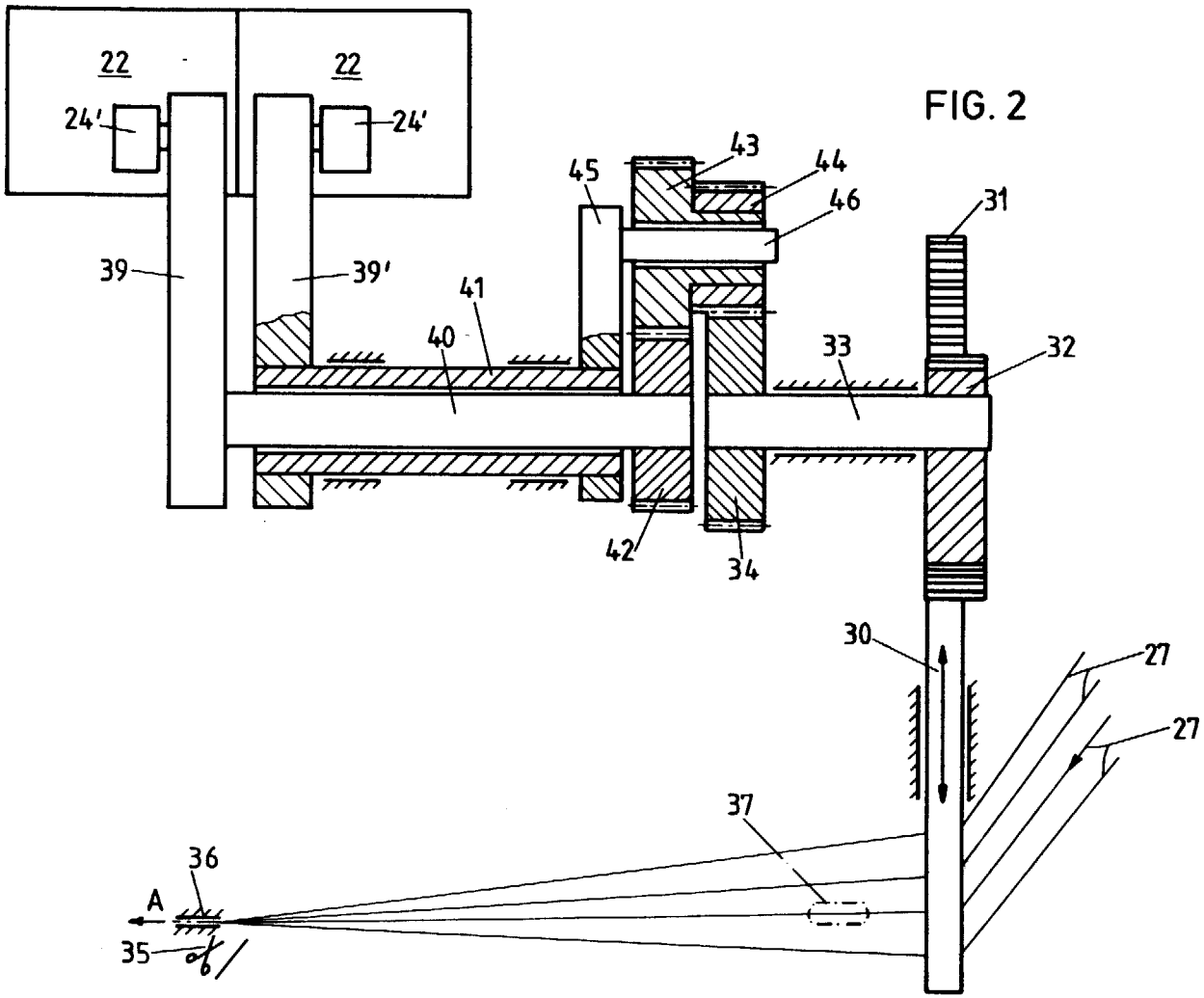

The weft thread selection device shown in FIG. 1 consists of a program control device 18 and a positioning device 20 and is provided with a microcomputer generally designated by 10 and which microcomputer comprises a microprocessor 11, a read-only memory 12, a pattern memory 13 and a keyboard 14 intended for programming and operating.

The microcomputer 10 can be, for instance, an 8-bit-microcomputer marketed by the National Semiconductors Company under the reference SC/MP and of which microcomputer the read-only memory 12 is a ½K-PROM and the read-write memory (random access memory) 13, here used as a pattern memory, is a ¼K-RAM. The weft pattern to be woven is read into the pattern memory 13 by means of the keyboard 14, i.e. the weft record which is cyclically repeated during the weaving is programmed and, in the course of the weaving process, is retrieved from the pattern memory 13 by means of the microprocessor 11, which responds to the weaving machine control 15. Stored in the read-only memory 12 is a permanent program for the input of the pattern stored in the pattern memory 13 into the positioning device 20 and for the work cycle of the weaving machine control. The keyboard 14 can be, for instance, a hexadecimal keyboard and can have additional control keys. For convenient input of the patterns into the pattern memory 13 it can be advantageously contemplated to make a part of the hexadecimal keyboard usable as a normal decimal keyboard.

The pattern memory 13 can advantageously be so constructed as to allow each storage element to store in addition to an address (the address can be, for instance, 0 to 255) the type of weft thread which is to be selected. There can be used, for instance, four different types of weft thread which can be designated by the numerals 0 to 3. Moreover, each storage element can additionally store one number, e.g. from 0 to 63, which indicates how often this particular weft thread is to be inserted successively into the weaving shed. For each weft thread exchange there has to be used a new storage element storing the data of the new weft thread to be brought into active position and the number of its successive insertions into the weaving shed. During the weaving process the storage elements are then retrieved, i.e. recalled according to their sequence. If, according to the above numerical example, the same weft thread is inserted into the weaving shed more than 64 successive times, the following storage element equally has to be programmed for this weft thread. At the end of a record the pattern memory 13 feeds a predetermined number into the microprocessor 11, e.g. the number 0, which causes the pattern memory 13 to be newly recalled from the beginning. Instead of the pattern memory described herein, pattern memories 13 of different suitable construction and different capacities can also be used.

The input program stored in the read-only memory 12 can preferably be so set up as to allow jumping back and forth in the pattern memory 13 and to change storage elements of such pattern memory 13 by simple overwriting. The output of the microprocessor 11 is connected through an interface 16 and a subsequently connected optical coupling device 17 to an output electronic circuit 19. Suitable optocouplers are manufactured, for instance, by F. A. Litronix Incor., Wallco Park, Cupertino, Calif. 95015, USA, under the name "Opto-Isolator IL 74". The output electronic circuit 19 is electrically decoupled or separated from the microprocessor 11 by the optocoupling device 17, so that no interference pulses from the high voltage part of the weaving machine can reach the microprocessor 11. The optical coupling device 17 converts the electrical output signals received via the interface 16 from the microprocessor 11 into optical signals, which, in turn, impinge upon photoelectric receivers which control current valves, e.g. thyristors of the output circuit 19, and which valves produce strong output current pulses.

Thus, the microcomputer 10 and the components 16, 17 and 19 together form an electric program control device 18 which in this exemplary embodiment program-controls, by means of its program control signals, the positioning device 20 for programmed positioning of two weft thread carriers 30 and which positioning device comprises two switching magnets 22 as electromagnets, each of which is a bistable electromagnet being constructed, for instance, as shown in FIG. 3.

The switching magnet 22 shown in FIG. 3 is provided with two separated permanent magnets 23 fixedly arranged in a housing 21 whereby their confronting front surfaces are equally polarised forming, for instance, two south poles. The permanent magnets 23 incorporate aligned bores with inserted bearing bushes for linear guidance of a rod 24' formed of non-magnetizable material, for instance brass, and to which rod there is secured between the permanent magnets 23 a collar formed of soft magnetic material, such as soft iron, and such collar serves as an armature 24 and is loosely surrounded by a stationary electric wire coil 25 which can be fed by the output electronic circuit 19 with positive and negative direct current pulses forming program control signals for switching the switching magnet 22 into its two stable positions. If, by a positive current pulse, the armature 24 has been moved to the position shown in the drawing, such armature can then be switched by a negative current pulse to the other position 30*a* indicated by phantom lines, since the armature 24 is correspondingly magnetized by this negative current pulse. Normally, the coil 25 is de-energized. In order to transfer the armature 24 from its momentary stable position to its other stable position, the coil 25 is energized with a current pulse of such polarity that the front surface of the armature 24 momentarily touching one of the permanent magnets 23 has the same polarity as the front surface of such permanent magnet 23, so that the armature is repelled from such magnet 23 and attracted by the other permanent magnet 23.

In FIG. 1 both of the two rods 24' of the switching magnet 22 carry a weft thread carrier 30 constructed as an eye. Through each of these two weft thread carriers 30 there is guided a weft thread 27 coming from a supply spool 26 and leading to a fabric web which is being woven on the not further illustrated weaving machine. The two weft threads 27 can be, for instance, weft threads of the same type and can be inserted into the weaving shed of the not illustrated fabric web by means of a not illustrated weft thread insertion device, with the purpose of rendering more even the fabric web in an alternating mixture. Since suitable weft thread insertion devices are known to the expert, they are not further illustrated herein. This weft thread insertion device can be, for instance, of the type inserting the weft threads into the weft weaving shed by means of two grippers of which the path of motion runs perpendicularly or obliquely to the plane of the drawing. Such gripper grips the weft thread 27 which has been pushed forward by means of the weft thread guide. After being gripped, the weft thread is cut between such gripper and the fabric web and is then guided to the center of the weaving shed where it is passed on to the other gripper which pulls the thread through the weaving shed completely, whereupon such thread is beaten. After each beating, a weft thread exchange can take place by switching the two switching magnets to their corresponding other stable position, preferably simultaneously.

In the positioning device 20, shown partly in sectional view in FIG. 2, two switching magnets 22 serve for the adjustment of a single rod-shaped and linearly guided weft thread carrier 30 which is provided with four through-passage bores for four different weft threads 27 and which at its one end is fixedly coupled with a rack 31, which meshes with a gear wheel 32 partly shown in sectional view and which gear wheel is secured to a rotatably mounted shaft 33 which has secured to its other end another gear wheel 34 which can be adjusted into four different angular positions by means of the two switching magnets 22, so that the weft thread carrier 30 can be correspondingly adjusted to four different vertical positions. In the illustrated position of the weft thread carrier 30 the second-lowest weft thread 27 is in its active position and, accordingly, the other three weft threads are in passive positions. The weft thread 27 in its momentary active position can for instance be inserted into the weaving shed of the fabric web 36, which is directed perpendicularly to the plane of the drawing and according to the arrow A moves from the right to the left by means of a gripper 37 moving perpendicular to the plane of the drawing. By means of the switching magnets 27 the weft thread carrier 30 can be adjusted into four different elevational positions by means of the illustrated mechanical gearing, thereby allowing each of the weft threads 27 to be brought from a passive position into the corresponding active position. The four weft threads 27 are delivered from not illustrated supply spools. The scissors 35 symbolize a cutting tool for cutting the weft thread gripped by the gripper 37, close to the corresponding selvage of the fabric web 36, thus cutting such gripped weft thread between the fabric web 36 and the gripper 37. Instead of inserting the weft threads 27 by means of grippers 37, other known weft thread insertion devices can be contemplated, such as known from shuttleless weaving machines, e.g. insertion by means of projectiles or water jet nozzles, compressed air nozzles or the like.

The two switching magnets 22 can be of the same design as shown in FIG. 3. However, their rods 24' carry no weft thread carrier. Rather, the two rods 24' both serve for the adjustment of a correspondingly associated, rotatably mounted lever 39, 39' into two different angular positions. The lever 39 is secured to the shaft 40 which extends through a hollow shaft 41 carrying the other lever 39' and is provided at its end remote from the lever 39 with a fixedly arranged gear wheel 42, which meshes with a gear wheel 43 to which a gear wheel 44 of smaller diameter is coaxially connected and which gear wheel 44 meshes with the gear wheel 34 which has a greater diameter than the gear wheel 44. The hollow shaft 41 carries at the end remote from the lever 39' a fixedly arranged arm 45 which carries coaxially arranged to the shaft 40 a shaft 46 on which the pair of gear wheels 43, 44 is rotatably mounted. The regulating distances of the switching magnets 22 and the illustrated gear wheels are so determined as to allow the positional adjustment of the required four different vertical positions of the weft thread carrier 30 by means of the switching magnets 22. These four vertical positions are designated by the reference characters a to d and if one designates the two bistable positions of each of the switching magnets 27 by A, B and A', B', then the four positions a to d are associated with the following positional combinations of the switching magnets 27: A, A'; A, B'; B, A'; B, B'.

In FIG. 4 there is shown a positioning device serving for a program controlled transfer of four weft threads 27 from passive to the corresponding active positions. These weft threads proceed from not illustrated supply spools and can, for instance, likewise be inserted into the weaving shed by means of shuttles or other insertion devices. Each rod 24' of the switching magnet 22 carries a weft thread carrier 30 constructed as an eye.

The feed directions of the weft threads are shown from right to left. In each case, one of the weft thread carriers 30 is in an active position corresponding to the active position of the weft thread guided by such weft thread carrier and the other weft thread carriers 30 are correspondingly in withdrawn passive positions. The longitudinal axis of the rods 24' can be in a common plane which, in this case, is the plane of the drawing and, referring to the longitudinal middle axis of the particular weft thread carrier 30 in active position, the directions of motion of the weft thread carriers 30 are radial.

It should be mentioned that it is advantageous to set-up the program so that only when a weft thread exchange is required a weft thread carrier 30 is moved from its active position to a passive position and is replaced by one of the other weft thread carriers 30 moving to the active position. Thus, should a weft thread in its active position be inserted several or many times successively into the weaving shed, then such weft thread carrier 30 is left in its active position until the next weft thread exchange.

The bistable switching magnets 22 make it possible, in the simplest way, to effect each switching by means of short direct current pulses. However, it is also possible, although not advisable in most cases, to provide the positioning device with a monostable electromagnet. An exemplary embodiment of a monostable electromagnet 22 is shown in FIG. 5. This electromagnet is provided with an armature 24 which extends from its free left-end to location 38 and is formed of soft magnetic material, e.g. soft iron, and which armature is extended by a coaxially arranged bar 24' of non-magnetizable material, e.g. brass. Such extension bar 24' carries at its free end a weft thread carrier 30. A pressure spring 49 pressing against the left-front surface of the coil 25 of this electromagnet on one side and against a counter support secured to the left end of the armature on the other side pushes the armature 24 and along with it the weft thread carrier 30 into the position shown in solid lines, as long as the coil 25 is de-energized. If the coil 25 is energized, the armature 24 is drawn further into the throughpassage bore of the coil 25 until the pressure spring 49 is compressed, so that the weft thread carrier 30 reaches the position shown in phantom lines, in which it remains as long as the coil 25 is energized. When the coil 25 is de-energized, the armature 24 and along with it the weft thread carrier 30, under the action of the compression spring 49, return to the position drawn in solid lines. Consequently, it is possible to replace the switching magnets 22, as shown in the exemplary embodiment according to FIG. 4, by monostable electromagnets as shown, for instance, in FIG. 5. Preferably, however, bistable switching magnets 22 instead of monostable electromagnets 22 are provided because bistable switching magnets only have to be electrically energized for a short time for switching and, thereafter, remain disconnected until the next switching and can thus be fed with strong current pulses without danger of thermal overloading.

If the stroke length of the armature 24 of the electromagnets 22 is too short for the directly corresponding positional adjustment of the weft thread carriers 30, it can advantageously be contemplated, provided that the force of the electromagnets is still sufficient for the positional adjustment of the weft thread carrier 30, that the height of lift of the weft thread carrier 30 be extended through the intermediary of a gearing or transmission arrangement located between such weft thread carrier and the electromagnets, as it is shown in an exemplary embodiment in FIG. 6. In this Figure, there is secured to the rod 24' of a switching magnet 22, which for the rest is constructed, for instance, according to FIG. 3, an entrainment element 50 which carries a cross pin 51 engaging into a longitudinal slot 52 in one arm 53 of a two-armed lever 55. This lever 55 is rotatably mounted at location 56 and its longer other arm 54 is provided at its free end with a longitudinal slot 57 into which engages a cross pin 58 of a linearly guided rod 59 which at its one end carries the weft thread carrier 30. As can easily be seen in FIG. 6, the stroke length of the rod 24' of the switching magnet 22 is mechanically changed-over into a several times longer stroke movement of the weft thread carrier 30, as a result of unequal length of the lever arms 53 and 54 of the two or double-arm lever 55. Of course, it is also possible to make the stroke length of the weft carrier 30 shorter than the stroke length of the armature of the associated switching magnet by means of a mechanical gearing or transmission arrangement, if it should be so desired for any reason.

In the previous exemplary embodiments, the mechanical energy serving for positioning the weft thread carriers 30 is supplied by the electromagnets 22 which are impinged by program control signals from the program control device. In the case of the bistable switching magnets, such energy directly serves for the to-and-fro motion of the weft thread carriers 30. In the case of the monostable electromagnet 22, according to FIG. 5, the motion of the weft thread carrier in one direction simultaneously pre-tensions the pressure spring 49 and the energy applied by the electromagnet 22 is stored by the pressure spring 49 and serves for resetting the weft thread carrier 30 when the electromagnet is de-energized.

If the output energy applied by the electromagnet or electromagnets of the positioning device is not sufficient to displace the weft thread carrier or carriers, the electromagnet or electromagnets can control a control device which controls a preselection apparatus which positions the weft thread carrier or carriers by means of energy supplied by the main motor of the weaving machine. A simple exemplary embodiment is shown in FIG. 7. Here, again, there is shown a weft thread carrier 30 provided with a bore 30' penetrated by the weft thread and such weft thread carrier is fixedly attached to a linearly guided bar 70, which normally is pressed by a return spring 71 against a fixedly arranged impact member 72. Mounted on the bar 70 is a linearly guided plunger 73 which is displaceable from the withdrawn position shown in solid lines to the position indicated by phantom lines by means of a bistable switching magnet 22, whereby such plunger 73 moves perpendicular to the guide motion of the bar 70. The switching magnet 22 is fixedly connected to the bar 70. The weft thread carrier 30, here again forming a thread guide, is movable against the action of its return spring 71, from the position shown in solid lines to the position indicated by phantom lines by means of the rotating cam disc 75 and the bar 70, and such weft thread carrier is displaced in this way when the plunger 73 has been moved by the switching magnet 22, to the position indicated by phantom lines, because then the cam disc 75 can obviously move the weft thread carrier 30 into the position indicated by phantom lines. However, if the plunger 73 is located in the withdrawn position, the cam disc 75 cannot move the weft thread carrier 30. The cam disc 75 is continuously driven during the weaving process and accomplishes one rotation per weft insertion. The actuation of the switching magnet 22 obviously occurs only when the plunger is out of contact with the cam disc 75. Each weft thread can be associated with such device, as illustrated, so that these devices together form the preselection apparatus.

In the case of a total of two weft threads, which preferably can serve for mixed alternation, it is also possible to provide the weft thread carrier 30 in FIG. 7, instead of with a single bore 30' with two bores 30', 30'' for guiding weft threads, so that the weft threads guided by such bores are located alternatively in the active positions. The weft thread guided by the eye 30', shown in solid lines in FIG. 7, could therefore be located, for instance, in its active position and the eye 30'', shown in broken lines, could guide the second weft thread which is momentarily in its passive position. It is thereby possible to use only one single weft thread carrier 30 for two weft threads.

Although in general only a single weft thread is inserted into the weaving shed of the fabric, cases can be thought of in which it is desirable that several weft threads can simultaneously be inserted into the weaving shed, whereby the combination of these simultaneously insertable weft threads can be changed in order to be able to increase the variety of the patterns of the fabric. For this purpose, it can be contemplated that several weft thread carriers can simultaneously transfer their associated weft threads to active positions, so that these weft threads are then inserted simultaneously into the weaving shed. Referring to the positioning device 20, according to FIG. 1, this can be achieved, for instance, by providing for the possibility of so programming the pattern memory 13 of the program control device 18 as to create the possibility of transferring both weft thread carriers 30 to their extended positions in which both weft threads guided by such weft thread carriers are in active positions, so that such weft threads can be simultaneously inserted into the weaving shed. In addition, there obviously remains the possibility of alternatively transferring the two weft thread carriers 30 to positions which bring the two weft threads, guided by such weft thread carriers, into active positions.

While there are shown and described present preferred embodiments of the invention, it is to be distinctly understood that the invention is not limited thereto, but may be otherwise variously embodied and practiced within the scope of the following claims. Accordingly,

What we claim is:

1. In a weaving machine, especially a shuttleless loom comprising a selection device for programmed selection of weft threads from a plurality of weft threads, each of which selected weft thread is to be inserted into a weaving shed by means of an insertion device, at least one weft thread carrier, said selection device comprising a program control device and a positioning device controllable by said program control device for displacing said at least one weft thread carrier which carries a related weft thread to a position where the momentarily selected weft thread is in an active position serving for the weft insertion and the other weft threads are in passive positions from which they cannot be inserted into the weaving shed, said program control device being constructed so as to produce electric program control signals, said positioning device comprising at least one electromagnet controllable by program control signals received from the program control device, said at least one electromagnet controlling the positioning of the weft thread carrier and serving to transfer the related weft thread thereof from the passive position to the active position and vice versa, said program control device comprising a microcomputer containing a read-only memory, a pattern memory, and a microprocessor, an output electronic circuit for supplying the program control signals to said at least one electromagnet, and said microprocessor controlling said output electronic circuit.

2. The weaving machine as defined in claim 1, further including an optical coupling device for operatively connecting said microprocessor with said output electronic circuit.

3. The weaving machine as defined in claim 1, wherein said at least one electromagnet comprises a bistable switching magnet. switching magnet.

4. The weaving machine as defined in claim 3, wherein a plurality of said electromagnets are provided, the number of which is equal to half the number of weft threads.

5. The weaving machine as defined in claim 1, wherein two of said electromagnets are provided, each electromagnet constituting a switching magnet, said at least one weft thread carrier guiding four weft threads, a first shaft, a first gear wheel operatively connected with said first shaft, a second gear wheel with which meshes said first gear wheel, a third gear wheel possessing a different diameter than said second gear wheel and fixedly connected with said second gear wheel, a fourth gear wheel with which meshes said third gear wheel, a first one of said switching magnets moving said first shaft into two different angular positions, a second shaft arranged coaxially with respect to said first shaft, said fourth gear wheel being secured to said second shaft and serving for positioning the weft thread carrier, said fourth gear wheel being movable by means of said two switching magnets into four different angular positions, a hollow shaft through which piercingly extends said first shaft, a second one of said two switching magnets moving said hollow shaft into two different angular positions, an axially parallel fourth shaft secured to said hollow shaft, and said second and third gear wheels being rotatably mounted at said fourth shaft.

6. The weaving machine as defined in claim 1, wherein a plurality of said weft thread carriers are provided for simultaneously transferring their related weft threads to active positions for simultaneously inserting such weft threads into the weaving shed.

* * * * *